US008037930B2

(12) United States Patent
Watanabe et al.

(10) Patent No.: US 8,037,930 B2
(45) Date of Patent: Oct. 18, 2011

(54) HEAT EXCHANGER

(75) Inventors: Haruhiko Watanabe, Yokkaichi (JP); Yuuji Sako, Hazu-gun (JP); Kyoujirou Nakata, Kariya (JP)

(73) Assignee: Denso Corporation, Kariya (JP)

( * ) Notice: Subject to any disclaimer, the term of this patent is extended or adjusted under 35 U.S.C. 154(b) by 1305 days.

(21) Appl. No.: 11/656,360

(22) Filed: Jan. 22, 2007

(65) Prior Publication Data

US 2007/0169926 A1 Jul. 26, 2007

(30) Foreign Application Priority Data

Jan. 24, 2006 (JP) ..... 2006-014888

(51) Int. Cl.

| | |
|---|---|
| ***F28F 9/02*** | (2006.01) |
| ***F28F 1/14*** | (2006.01) |
| ***F28F 1/36*** | (2006.01) |
| ***F28F 1/42*** | (2006.01) |

(52) U.S. Cl. ..... 165/175; 165/172; 165/177; 165/179; 165/183; 29/890.03; 29/890.038; 29/890.046; 29/890.049

(58) Field of Classification Search ..... 165/148, 165/151, 172, 173, 174, 175, 177, 179, 181, 165/183; 29/890.03, 890.038, 890.045, 890.046, 29/890.049

See application file for complete search history.

(56) References Cited

U.S. PATENT DOCUMENTS

| | | | | |
|---|---|---|---|---|
| 4,501,321 | A * | 2/1985 | Real et al. | 165/170 |
| 4,805,693 | A | 2/1989 | Flessate | |
| 4,932,467 | A * | 6/1990 | Wigmore et al. | 165/166 |
| 5,185,925 | A * | 2/1993 | Ryan et al. | 29/890.049 |
| 5,730,215 | A * | 3/1998 | Hirano et al. | 165/183 |
| 5,784,776 | A * | 7/1998 | Saito et al. | 29/890.045 |
| 5,881,457 | A * | 3/1999 | Liu | 29/890.045 |
| 6,209,202 | B1 * | 4/2001 | Rhodes et al. | 165/183 |
| 6,640,886 | B2 * | 11/2003 | Lamich | 165/183 |
| 7,152,671 | B2 * | 12/2006 | Shibagaki et al. | 165/177 |
| 7,204,302 | B2 * | 4/2007 | Shibagaki et al. | 165/170 |
| 7,461,689 | B2 * | 12/2008 | Merklein et al. | 165/173 |
| 7,686,070 | B2 * | 3/2010 | Chu et al. | 165/177 |
| 2003/0010480 | A1 | 1/2003 | Shibagaki et al. | |
| 2005/0121179 | A1 | 6/2005 | Shibagaki et al. | |
| 2005/0173100 | A1 | 8/2005 | Takai et al. | |

FOREIGN PATENT DOCUMENTS

| | | |
|---|---|---|
| CN | 1645029 | 7/2005 |
| JP | 2003-28586 | 1/2003 |
| JP | 2004-150673 | 5/2004 |
| JP | 2004-293988 | 10/2004 |

OTHER PUBLICATIONS

Office action dated Jul. 11, 2008 in Chinese Application No. 2006 10172463.1 with English translation thereof.

* cited by examiner

*Primary Examiner* — Ljiljana Ciric

(74) *Attorney, Agent, or Firm* — Harness, Dickey & Pierce, PLC

(57) ABSTRACT

A tube is composed of a first plate and a second plate which are opposed and engaged with each other. In a first region on both end sides of the tube, the first plate is formed into a shape in which an edge portion of the first plate is laid along a bent portion of the second plate so that an outer wall face of the tube forms a continuous face. In a second region of the tube, the first plate is formed into a shape in which the edge portion of the first plate is laid between the edge portion of the second plate and the bent portion of the second plate.

6 Claims, 8 Drawing Sheets

HEAT EXCHANGER

BACKGROUND OF THE INVENTION

1. Technical Field of the Invention

The present invention relates to a fin-and-tube-type heat exchanger, in the tube of which an inner fin is provided. The fin-and-tube-type heat exchanger of the present invention is preferably used for an inter-cooler for cooling suction air of an internal combustion engine and can also be used for a condenser for emitting the heat of a thermal medium of an air conditioner.

2. Description of the Related Art

In a conventional tube of a heat exchanger into which an inner fin is incorporated, a set of plates are engaged with each other so that an inner fin can be interposed between them, as described in the official gazette of JP-A-2003-28586 (FIGS. 6 and 8). In the case where the tube is divided into two pieces as described above, at the time of forming the tube, it is easy to incorporate the fin into the tube.

However, in the case where the tube is divided into two pieces, the following problems may be encountered. In a portion in which the plates are engaged with each other, on an outer wall face of the tube, a step portion is formed which corresponds to the wall thickness of the plate arranged outside. When this step portion is formed, at the time of inserting the tube onto a header plate, a gap is formed between the outer wall face of the tube and the opening edge of the opening portion of the header plate. Accordingly, at the time of brazing, a brazing failure may occur.

As a means for solving the above problem, a tube has been proposed, and the structure disclosed, in FIG. 6 of the official gazette of JP-A-2003-28586. That is, a tube, the cross-section of which is substantially a flat rectangle, is composed in such a manner that a first plate, the lateral cross-section of which is substantially a C-shape, and a second plate, the lateral cross-section of which is also substantially a C-shape, are opposed and engaged with each other. In a portion in which both plates are engaged mutually, the first plate is located outside the second plate. An edge portion of the first plate is formed into a shape which lies along a bent portion of the second plate. Due to the above structure, the outer wall face of the tube is composed of continuous face.

The present inventors have investigated application of the tube described above to a fin-and-tube-type heat exchanger. FIG. 13 is a sectional view showing a tube and an outer fin of the heat exchanger which the present inventors investigated. In this connection, FIG. 13 corresponds to a sectional view taken on line III-III in FIG. 1.

As shown in FIG. 13, the tube 2 has a lateral sectional shape formed into substantially a flat rectangle. The first plate 6, the lateral cross section of which is formed into a substantial C-shape, and the second plate 7, the lateral cross section of which is also formed into a substantial C-shape, are opposed and engaged with each other. In a portion in which both plates 6, 7 are engaged mutually, in order to make an outer wall face of the tube 2 to be continuous face, an edge portion 6*a* of the first plate 6 composing the outer wall face is located in a bent portion 7*b* of the second plate 7 with respect to the entire tube 2, and the edge portion 6*a* of the first plate 6 is formed into a shape which lies along the bent portion 7*b* of the second plate 7.

In the tube 2, an inner fin 5 is arranged. On an outer wall face of the tube 2, an outer fin 3 is provided. This outer fin 3 is arranged only on a main surface 2*a* which is one of the surfaces including the main surface 2*a* shown in FIG. 13 composing a long side of the substantial rectangle on the lateral cross section of the tube and the side 2*b* shown in FIG. 13 composing a short side of the substantial rectangle. In this connection, in FIG. 13, an outer fin arranged on the main surface 2*a* on the lower side of the drawing is omitted.

Even in this case, the outer wall face of the tube 2 is substantially composed of continuous face. Therefore, it is possible to solve the problem explained in the item of the background art.

However, when the tube 2 is composed as described above, the following problems may be encountered. At the time of manufacturing the heat exchanger, when the first plate 6, the second plate 7, the inner fin 5 and the outer fin 3 are simultaneously brazed mutually in a furnace, in the case where a failure is caused in brazing of the first and the second plate, it is difficult to conduct repairing. That is, when a brazing failure may occur, repairing is usually conducted in such a manner that a brazing filler metal is arranged in a portion in which the failure of brazing is caused and a torch brazing is conducted in which the defective portion is heated with a burner. However, since the edge portion 6*a* of the first plate 6 is located in the bent portion 7*b* of the second plate 7 and the edge portion 6*a* of the first plate 6 is obstructed by the outer fin 3, it is impossible to arrange the brazing filler metal in the neighborhood of the edge portion 6*a* of the first plate 6. When repairing is forcibly conducted, the outer fin 3 is melted by the burner. Therefore, it is difficult to conduct repairing.

The above problems are caused not only in the tube composed in such a manner that the tube is formed out of two divided plates but also in the tube composed in such a manner that the tube is formed out of one plate and both edge portions of the one plate, which are opposed mutually, are engaged mutually so that the tube can be formed.

SUMMARY OF THE INVENTION

The present invention has been accomplished in view of the above points. An object of the present invention is to provide a heat exchanger capable allowing easy repairing work at the time of the occurrence of a failure when brazing plates which compose a tube while the occurrence of a failure to brazing the tube to a header plate is being suppressed.

In order to accomplish the above object, in the first embodiment of the present invention, a tube (2) is formed into a shape described as follows. First edge portions (6*a*, 8*a*) of plates (6, 7, 8) composing the tube are arranged outside second edge portions (7*a*, 8*b*) and the plates (6, 7, 8) are put on mutually and portions, on which the plates (6, 7, 8) are put on mutually, are brazed mutually. With respect to these plates (6, 7, 8), positions of the first edge portions (6*a*, 8*a*) in an engagement portion (C) with the header plate of the tube are different from positions of the first edge portions (6*a*, 8*a*) in a portion (D) except for the engagement portion. In the engagement portion (C), the first edge portions (6*a*, 8*a*) are located at positions where an outer wall face of the tube is composed of continuous face. In the portion (D) except for the engagement portion, the first edge portions (6*a*, 8*a*) are located in a portion on the outer face where an outer fin (3) is not provided.

According to the present invention, in the portion except for the engagement portion, the first edge portion of the plate is located in a portion on the outer wall face where the outer fin is not provided. Since the first edge portion of the plate is distant from the outer fin, it is possible to enhance the working property of the repairing work at the time of the occurrence of a failure of brazing the plates.

According to the present invention, in the engagement portion, the first edge portion of the plate is located at a position in which the outer wall face of the tube is composed of continuous face. Accordingly, it is possible to suppress the occurrence of a failure of brazing the tube to the header plate.

According to the second embodiment of the present invention, in the case where a lateral cross section of the tube (2) is formed into a substantial rectangle and the outer fin (3) is provided only on a face (2*a*) which becomes a long side of the rectangle on the outer wall face of the tube (2), the tube (2) is formed into a shape described as follows. The first plate (6) and the second plate (7) are opposed and engaged mutually so that portions (2*b*), which are short sides of the rectangle, can be put on mutually. At this time, shapes of the first and the second plate (6, 7) are formed in such a manner that, in the engagement portion (C) of the tube with the header plate, an edge portion (6*a*) of the plate (6) located outside a portion where the first and the second plate (6, 7) are put on mutually reaches a bent portion (7*b*) of the other plate (7) so that an outer wall face of the tube (2) will be composed of continuous face. In the portion (D) except for the engagement portion of the tube with the header plate, the edge portion (6*a*) of one plate (6) located outside the portion where the first and the second plate are put on mutually is located between the edge portion (7*a*) of the other plate (7) and the bent portion (7*b*).

According to the third embodiment of the present invention, the tube (2) can be formed into the following shape. One edge (8*a*) and the other edge (8*b*) of one plate (8) are put on each other in a portion (2*b*) of the tube, which is a side of a rectangle, while one edge (8*a*) is located outside. At this time, a shape of a plate (8) is formed as follows. In the engagement portion (C) of the tube with a header plate, one edge (8*a*) is located at a bent portion (8*c*) on the other edge (8*b*) side so that an outer wall face of the tube will be composed of continuous face. In the portion (D) except for the engagement portion of the tube with the header plate, one edge (8*a*) is located between the other edge (8*b*) and the bent portion (8*c*).

In this connection, reference numerals and signs in the parentheses of each means described in the scope of claim and this column are one example showing a relation corresponding to the specific means of the embodiment described later.

The present invention may be more fully understood from the description of preferred embodiments of the invention, as set forth below, together with the accompanying drawings.

DESCRIPTION OF THE PREFERRED EMBODIMENTS

First Embodiment

Figure 1:
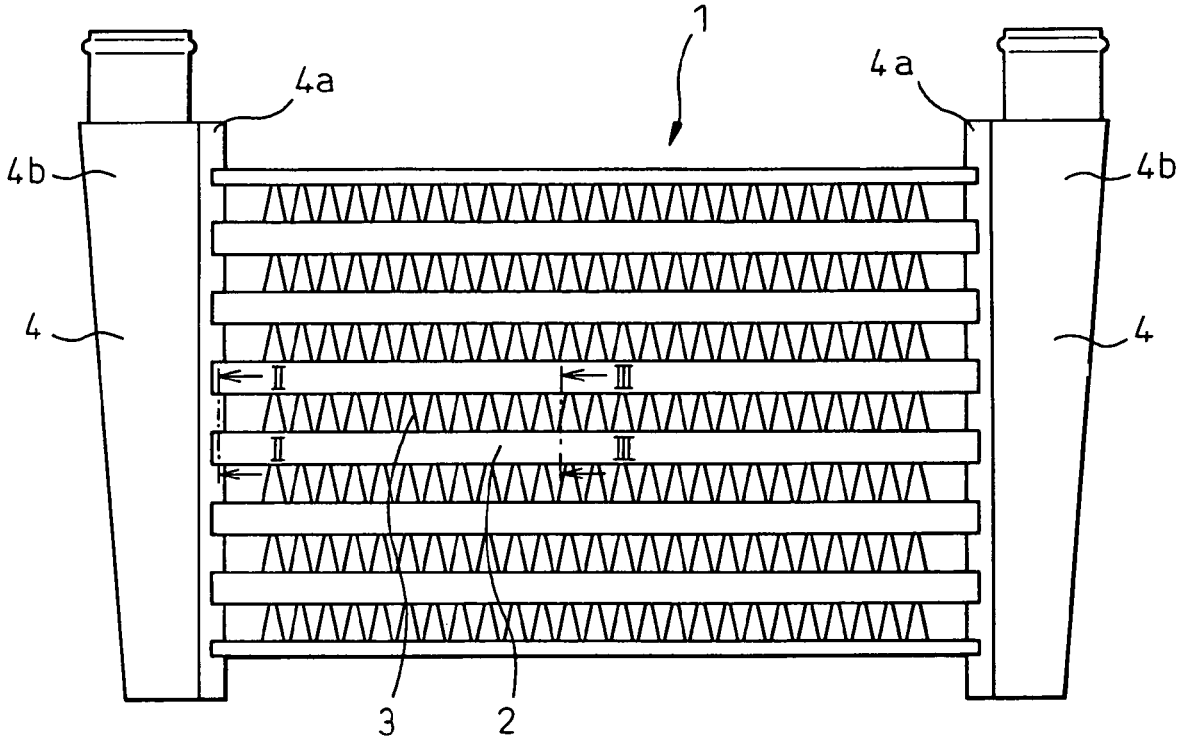
FIG. 1 is a front view of a heat exchanger of the first embodiment of the present invention.

FIG. 1 is an overall arrangement view showing a heat exchanger of the first embodiment of the present invention. In this embodiment, explanations are made into an example in which the heat exchanger of the present invention is applied to an inter-cooler. In this connection, although not shown in the drawing, the inter-cooler described in the present embodiment is arranged on the downstream side of a suction air current of a supercharger which pressurizes suction air sucked into an internal combustion engine so as to cool the suction air by exchanging heat between the suction air and a cooling wind.

As shown in FIG. 1, the inter-cooler 1 is a fin-and-tube-type heat exchanger and includes: a plurality of tubes 2 arranged in parallel mutually; and outer fins 3 arranged between the tubes 2 which are adjacent mutually. The inter-cooler 1 further includes header tanks 4 arranged on both end sides in the longitudinal direction of the tubes 2. In this connection, in FIG. 1, the lateral direction in the drawing is the same as the longitudinal direction of the tubes 2.

Each tube 2 composes a passage in which suction air is made to flow. As described later, the tube 2 is formed into a flat shape (shown in FIGS. 2 to 4). Each tube 2 is arranged so that the major axis direction of the tube can agree with a current of cooling air which flows in a direction perpendicular to the surface of FIG. 1.

Each outer fin 3 is formed into a wave-shape and joined to the tube 2. The outer fin 3 facilitates heat exchange conducted between a cooling air flow, which flows between the tubes 2, and a current of suction air flowing in the tubes 2.

The header tanks 4 function as follows. One of the header tanks 4 distributes the suction air, which has been sent with pressure from a supercharger not shown, into each tube 2. The other header tank 4 collects the suction air which has flowed out from each tube 2 and sends it to a suction port of an internal combustion engine not shown. Each header tank 4 includes: a header plate 4*a* having opening portions; and a tank body 4*b* composing a space inside the tank together with the header plate 4*a*. The tubes 2 are inserted into the opening portions of the header plate 4*a*. The header plate 4*a* and the tubes 2 are engaged mutually. In this connection, the outer fin 3 and the header tank 4 are made of, for example, copper or stainless steel.

Figure 2:
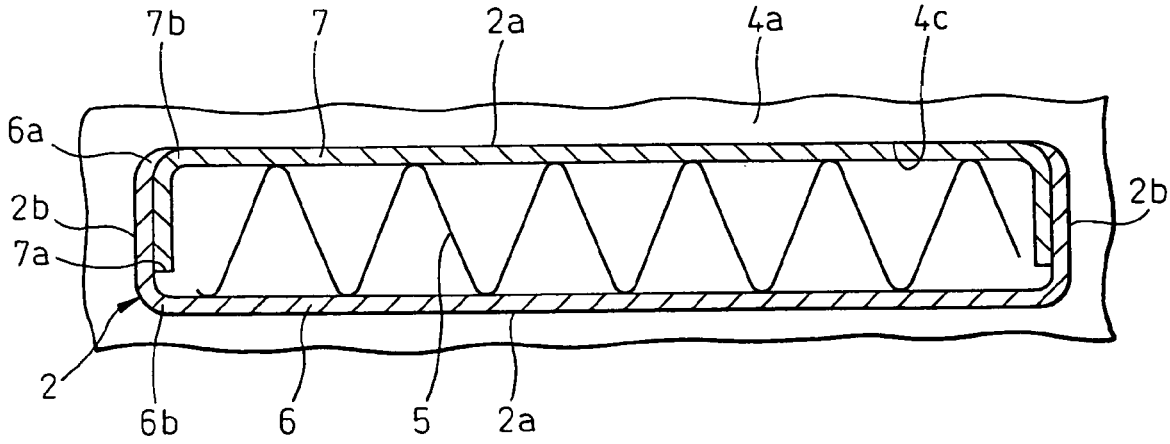
FIG. 2 is a sectional view taken on line II-II in FIG. 1.
Figure 3:
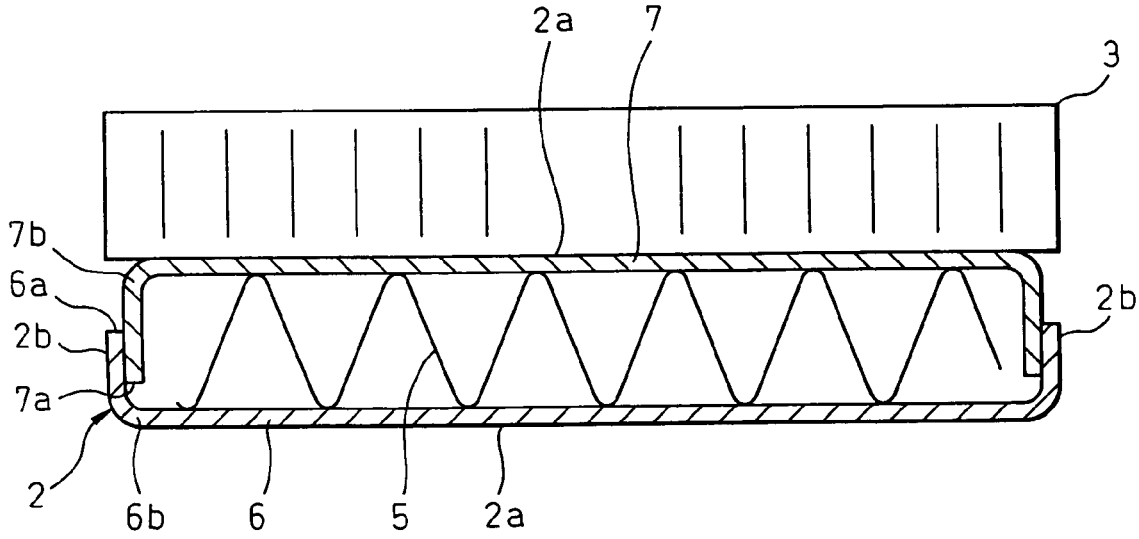
FIG. 3 is a sectional view taken on line III-III in FIG. 1.
Figure 4:
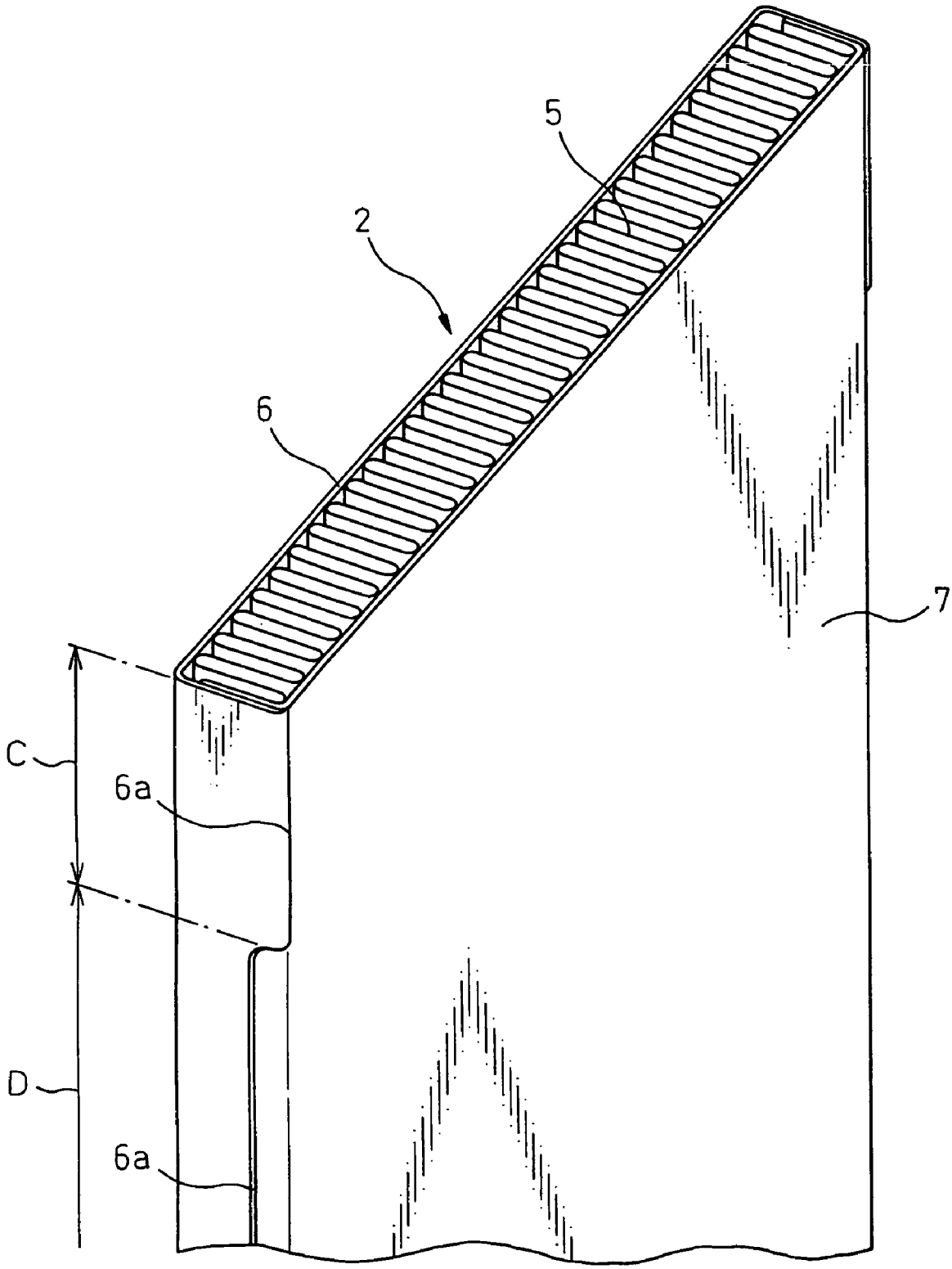
FIG. 4 is a perspective view showing the neighborhood of the tube edge portion shown in FIG. 1.

Next, the tube 2 will be explained in detail. FIG. 2 is a sectional view taken on line II-II in FIG. 1. FIG. 3 is a sectional view taken on line III-III in FIG. 1. FIG. 4 is a perspective view showing the neighborhood of the tube edge portion shown in FIG. 1. In this connection, in FIG. 4, the vertical direction in the drawing is the same as the longitudinal direction of the tube 2. The lateral sectional view of the region C in the drawing corresponds to FIG. 2. The lateral sectional view of the region D in the drawing corresponds to FIG. 3.

As shown in FIGS. 2 to 4, the lateral cross-section of the tube 2 is a substantial rectangle, the corners of which are round. In the following descriptions, a face, which is one of the outer wall faces of the tube 2 and formed to be a long side of the rectangle of the lateral cross-section shape, and which is parallel with the major axis direction of the tube 2, will be referred to as a main surface 2*a*, hereinafter. A face, which is a short side of the rectangle and parallel with the minor axis direction of the tube 2, will be referred to as a side 2*b*, hereinafter.

Inside each tube 2, an inner fin 5 is arranged. This inner fin 5 is formed into a wave shape and is joined to the tube 2. Therefore, the inner fin 5 facilitates heat exchange between the cooling air flow and the suction air.

As shown in FIGS. 2 and 3, the tube 2 is composed in such a manner that two plates 6, 7, the lateral cross sections of which are symmetrical and formed into a substantial C-shape, are opposed and engaged mutually. One of these two plates 6, 7, which is located on the lower side in FIGS. 2 and 3, is a first plate 6. The other of these two plates 6, 7, which is located on the upper side in FIGS. 2 and 3, is a second plate 7. The first and the second plate 6, 7 are made of, for example, copper, stainless steel or carbon steel.

The first and the second plate 6, 7 are put on mutually on the side 2*b* of the tube 2 while the first plate 6 is being located outside and the second plate 7 is being located inside. In this portion in which the first and the second plate 6, 7 are put on mutually, the first and the second plate 6, 7 are brazed mutually.

As shown in FIG. 4, a shape of the edge portion 6*a* of the first plate 6 in the region C, which is located on both end sides of the tube 2, is different from a shape of the edge portion 6*a* of the first plate 6 in the region D except for both end sides of the tube 2.

Specifically, as shown in FIG. 2, the portion of the region C located on both end sides of the tube 2 is a portion to be engaged with the header plate 4*a*. The edge portion 6*a* of the first plate 6 is located at a bent portion 7*b* of the second plate 7. A forward edge portion of the edge portion 6*a* of the first plate 6 is tapered and further formed into a shape laid along the bent portion 7*b* of the second plate 7. Due to the above structure, no step portions are formed on the outer wall face of the tube 2, that is, the outer wall face of the tube 2 is continuous face. Accordingly, no gaps are formed between the outer wall faces 2*a*, 2*b* of the tube 2 and the opening portion 4*c* of the header plate 4*a*. As a result, the tube 2 and the header plate 4*a* can be properly brazed mutually.

On the other hand, as shown in FIG. 3, in the region D except for both end sides of the tube 2, the outer fin 3 is joined only onto the main surface 2*a* which is one of the main surface 2*a* and the side 2*b* composing the outer wall face of the tube 2. In this region D, the edge portion 6*a* of the first plate 6 does not reach the bent portion 7*b* of the second plate 7, that is, the edge portion 6*a* of the first plate 6 is located between the edge portion 7*a* of the second plate 7 and the bent portion 7*b*. That is, the edge portion 6*a* of the first plate 6 is located on the side 2*b* of the tube 2, on which the outer fin 3 is not provided, and distant from the outer fin 3.

In the present embodiment, the edge portion 6*a* of the first plate 6 and the edge portion 7*a* of the second plate 7 respectively correspond to the first edge portion and the second edge portion described in the scope of claim.

A shape of the edge portion 7*a* of the second plate 7 is the same with respect to the entire tube. As shown in FIGS. 2 and 3, the edge portion 7*a* is located between the edge portion 6*a* of the first plate 6 and the bent portion 6*b*.

Figure 5:
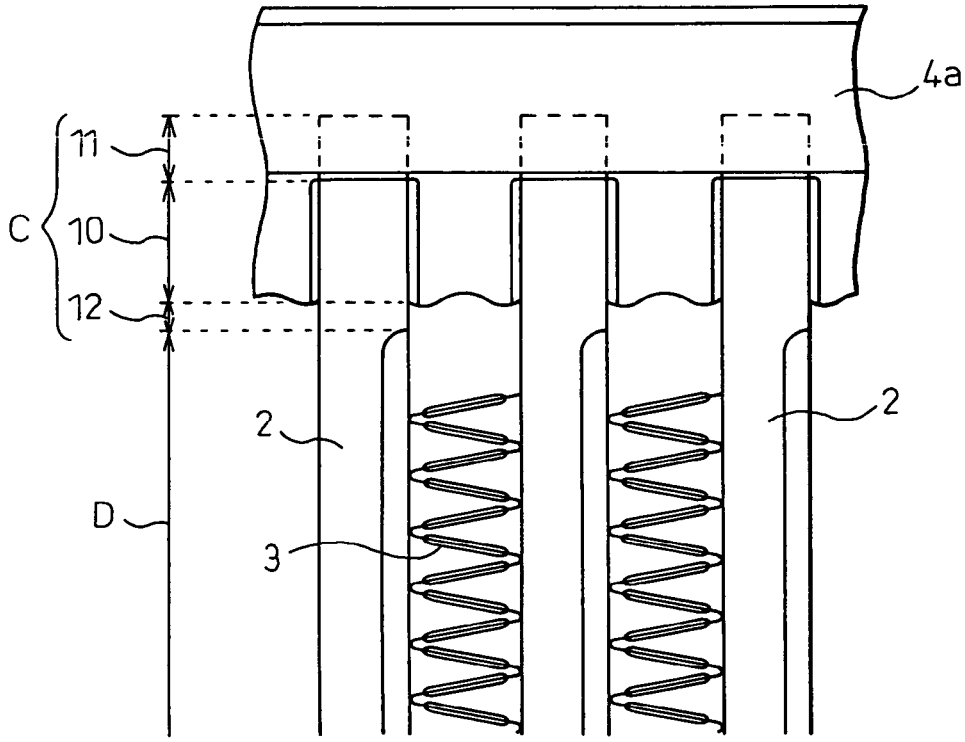
FIG. 5 is an enlarged view showing an engagement portion of the tube 6 and the header plate 4*a* in FIG. 1.

FIG. 5 is a view showing circumstances of the engagement of the tube 6 with the header plate 4*a*.

A length of the region C located on both sides of the tube 2 is determined according to a header plate engagement portion 10 which is directly put on and engaged with the header plate 4*a*, according to a protruding portion 11 in which a forward edge portion of the tube 2 is protruded from the header plate engagement portion 10 and according to a redundant portion 12 provided when consideration is given to an assembling tolerance of assembling the tube 2 and the header plate 4*a*.

The header plate engagement portion 10 is a region indispensable to the reduction of an engagement gap between the tube 2 and the header plate 4*a*. The protruding portion 11 and the redundant portion 12 are regions indispensable to the elimination of an engagement gap of the tube 2 with the header plate 4*a* even when the tube 2 and the header plate engagement portion 10 are shifted in the tube insertion direction.

Next, a position of the outer fin 3 will be explained below. As shown in FIG. 5, the outer fin 3 is arranged at a position distant from the header plate 4*a* with respect to a displacement portion in which a position of the edge portion 6*a* of the first plate 6 is changed in the longitudinal direction of the tube 2, that is, the outer fin 3 is arranged at a position distant from the header plate 4*a* with respect to an edge portion of the region C on the region D side. A distance between the header plate 4*a* and the outer fin 3 is, for example, 2 to 3 mm.

Figure 6:
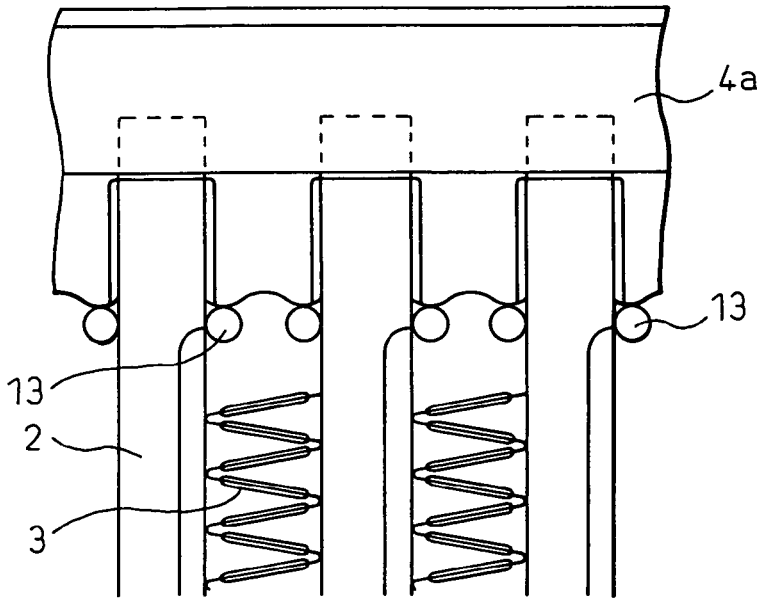
FIG. 6 is a view showing circumstances at the time of brazing the tube 6 to the header plate 4*a* in FIG. 1.
Figure 7:
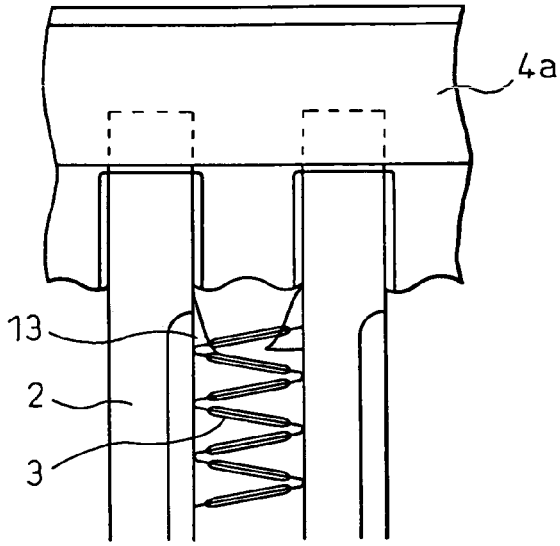
FIG. 7 is a view of a comparative example of the first embodiment showing circumstances in which the tube 6 and the header plate 4*a* are brazed mutually in the case where the outer fin 3 is packed even to a portion right below the header plate 4*a;*

In this case, in order to explain the reason why the outer fin 3 is arranged as described above, the circumstances in which the header plate 4*a* and the tube 2 are brazed mutually are shown in FIGS. 6 and 7. FIG. 6 is a view showing the present embodiment. FIG. 7 is a view showing a case in which the outer fin 3 is packed to a portion right below the header plate 4*a*.

When consideration is given to the emitting performance and the uniform compression of the core at the time of brazing, as shown in FIG. 7, it is desirable that the last ridge of the outer fin 3 is packed at a position right below the header plate 4*a*.

However, when the first plate 6, the second plate 7, the core plate 4*a* and the outer fin 3 are brazed after these components have been incorporated mutually, a brazing filler metal 13 is arranged in the neighborhood of the opening portion of the header plate 4*a* into which the tube 2 is inserted. However, in the case where the outer fin 3 is provided at a position right below the header plate 4*a*, it becomes difficult to arrange the brazing filler metal. In this case, even when the brazing filler metal 13 is arranged, as shown in FIG. 7, the brazing filler metal 13 is attracted to the outer fin 3. Therefore, a quantity of the brazing filler metal necessary for joining the tube 2 to the header plate 4*a* is lacking. Accordingly, it becomes impossible to braze the tube 2 to the header plate 4*a*.

On the other hand, in the present embodiment, since the outer fin 3 is distant from the position where the brazing filler metal 13 is arranged as shown in FIG. 6, compared with the case shown in FIG. 7, the brazing filler metal can be easily supplied. Further, it is possible to prevent the brazing filler metal from being attracted to the outer fin 3.

Next, the primary advantages of the present embodiment will be explained below.

In the present embodiment, as described above, the tube 2 includes the first and the second plate 6, 7 which are opposed and engaged mutually. In the region D except for both end sides of the tube 2, the shape of the first plate 6 is formed in such a manner that an edge portion of the first plate 6 shown in FIG. 13 is cut out, that is, the shape of the first plate 6 is formed in such a manner that the edge portion 6*a* is located between the edge portion 7*a* of the second plate 7 and the bent portion 7*b*.

As described above, in the present invention, since the edge portion 6*a* of the first plate 6 is distant from the outer fin 3, in the case where a failure of brazing the first and the second plate 6, 7 is caused, it is possible to arrange the brazing filler metal in the neighborhood of the edge portion 6*a* of the first plate 6. Therefore, a portion, in which the failure of brazing the first and the second plate 6, 7 is caused, can be brazed with a torch without melting the outer fin by a burner.

Figure 8:
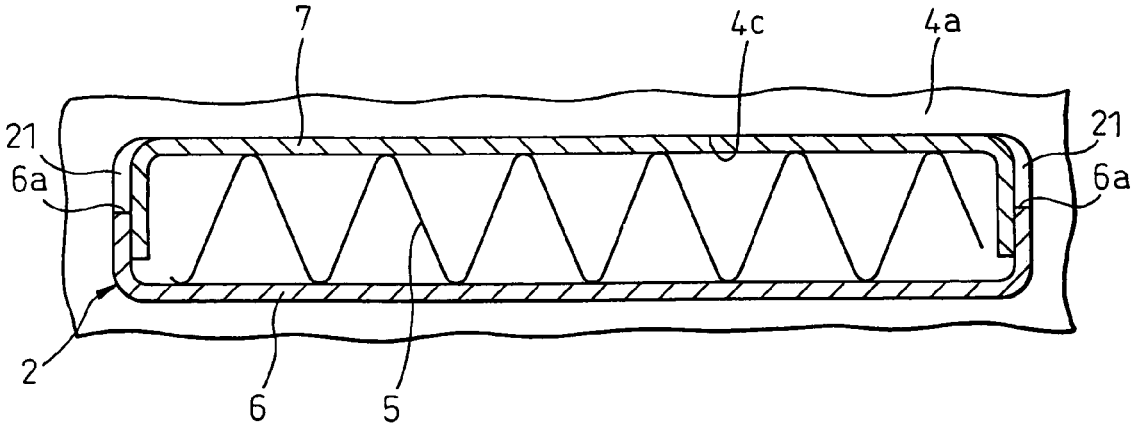
FIG. 8 is a sectional view taken on line II-II in FIG. 1 in the comparative example of the first embodiment.

However, when the edge portion 6*a* of the first plate 6 is positioned as described above even in the region C on both end sides of the tube 2, as shown in FIG. 8, in the neighborhood of the edge portion 6*a* of the first plate 6, a gap 21 is formed between the outer wall face of the tube 2 and the opening edge of the opening portion 4*c* of the header plate 4*a*. Accordingly, it becomes difficult to braze the tube 2 and the header plate 4*a* mutually.

Figure 13:
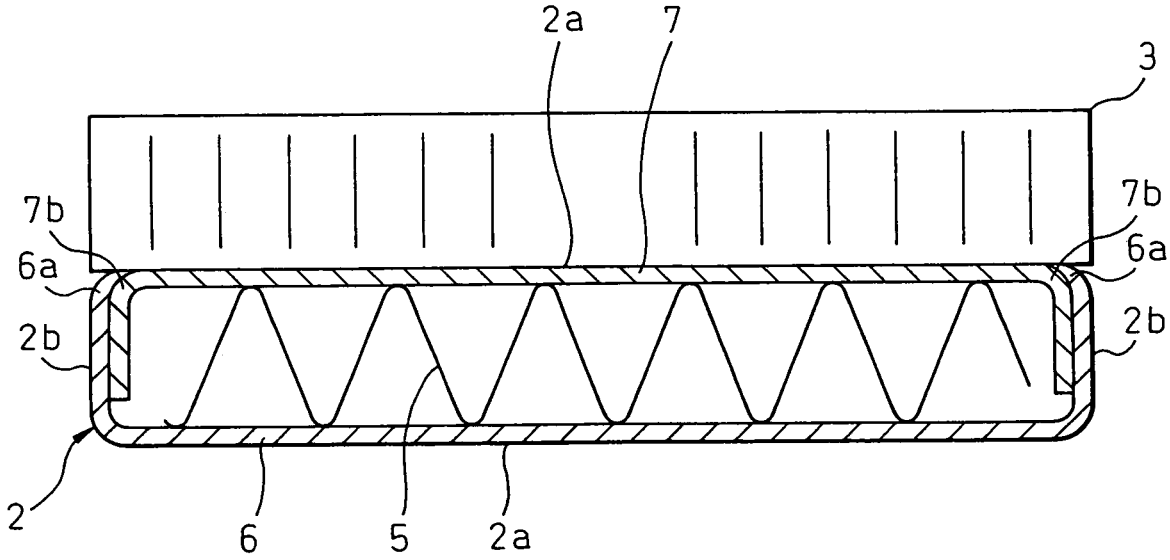
FIG. 13 is a lateral sectional view of the tube into which the present inventors made investigation.

Accordingly, in the present embodiment, in the region C on both end sides of the tube 2, the edge portion of the first plate shown in FIG. 13 is not cut out but the first plate 6 is formed into a shape in which the edge portion 6*a* of the first plate is laid along the bent portion 7*b* of the second plate so that an outer wall face of the tube will be continuous face.

As described above, according to the present embodiment, while the occurrence of a failure of brazing the tube 2 and the header plate 4*a* is being suppressed, the working property of repairing work can be enhanced which is conducted when a failure of brazing the first and the second plate 6, 7 composing the tube 2 is caused.

In this connection, concerning the structure in which the tube 2 is divided into two parts, as described in FIG. 3 of the official gazette of JP-A-2003-28586, a structure is provided in which a step portion, which corresponds to the thickness of the first plate, is formed on the second plate. Even in this case, the outer wall face of the tube is continuous face and the edge portion of the first plate is separated from the bent portion of the second plate. Therefore, this case can provide the same advantage as that of the present embodiment. However, in this case, it is necessary to apply a technique by which a step portion corresponding to the thickness of the first plate is provided on the second plate.

On the other hand, the tube 2 of the present embodiment is composed in such a manner that the first plate 6 and the second plate 7, which have been cut to a predetermined shape, are respectively bent so that a cross-section can be formed into a C-shape and the thus bent plates are engaged mutually. In this case, a technique by which the first plate is cut is easier than a technique by which the step portion corresponding to the thickness of the first plate is formed on the second plate.

Accordingly, the tube can be more easily manufactured by the technique of the present embodiment than that disclosed in the official gazette of JP-A-2003-28586.

Second Embodiment

Figure 9:
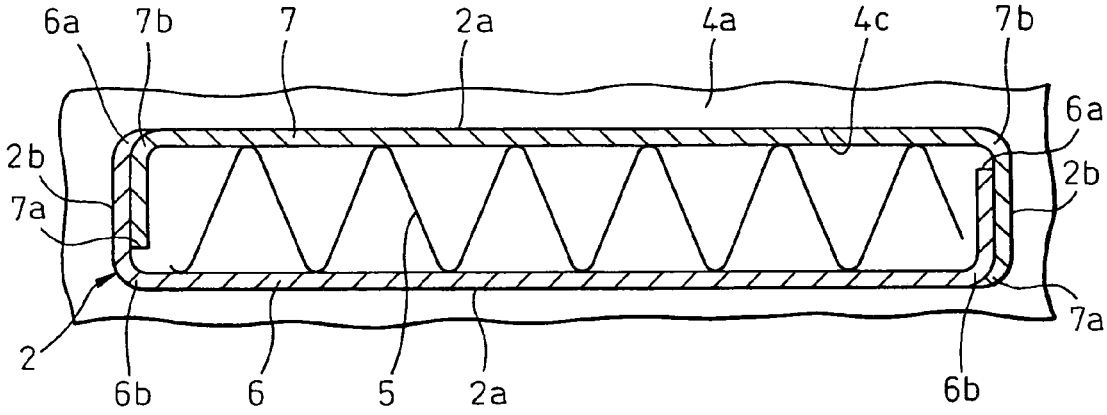
FIG. 9 is a lateral sectional view of the tube of the second embodiment of the present invention.
Figure 10:
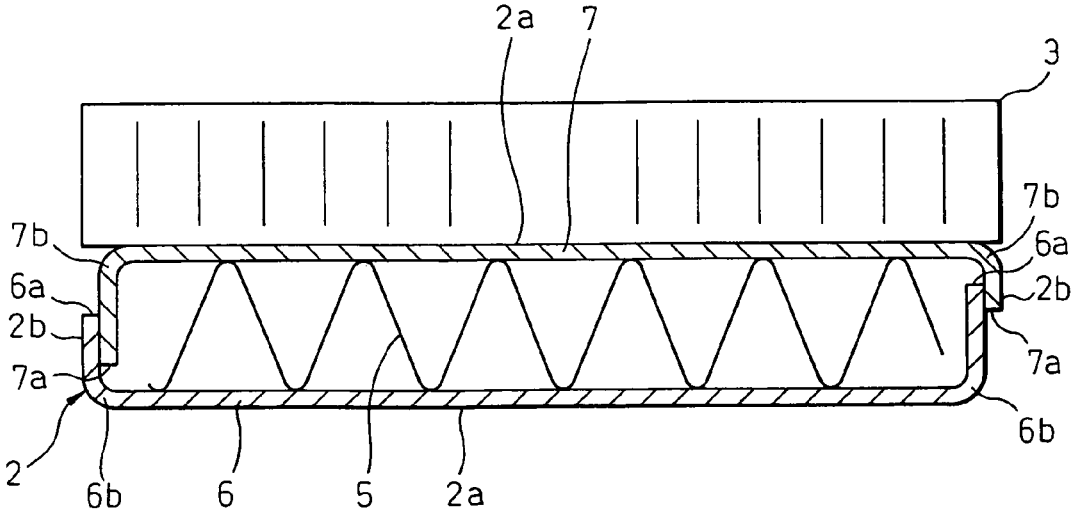
FIG. 10 is a lateral sectional view of the tube of the second embodiment of the present invention.

FIGS. 9 and 10 are lateral sectional views showing a tube of the second embodiment of the present invention. FIG. 9 is a sectional view taken on line II-II in FIG. 1. FIG. 10 is a sectional view taken on line III-III in FIG. 1. Like reference characters are used to indicate like parts in FIGS. 2, 3, 9 and 10.

As shown in FIGS. 2 and 3, in the tube 2 of the first embodiment, the lateral cross-sectional shape is symmetrical in the lateral direction. However, as shown in FIGS. 9 and 10, in the tube 2 of the present embodiment, the lateral cross-sectional shape is not symmetrical in the lateral direction. That is, in the tube 2 of the present embodiment, on the left of the tube 2 in the drawing, in the same manner as that of the first embodiment, the first plate 6 is located outside. However, on the right of the tube 2 in the drawing, and different from the first embodiment, the second plate 7 is located outside.

In this case, only the right of the tube 2 in the drawing will be explained below. In the region C located on both end sides of the tube 2, as shown in FIG. 9, a forward edge portion of the edge portion 7*a* of the second plate 7 is tapered and a shape of the edge portion 7*a* of the second plate 7 is formed so that it can be laid along the bent portion 6*b* of the first plate 6. On the other hand, in the region D except for both end sides of the tube 2, as shown in FIG. 10, the edge portion 7*a* of the second plate 7 is located between the edge portion 6*a* of the first plate 6 and the bent portion 6*b*.

As described above, in the present embodiment, concerning the first and the second plate 6, 7, a shape of the edge portion 6*a*, 7*a* of one plate located outside, in the portion where the first and the second plate 6, 7 are put on mutually in the region C, is different from that in the region D. Therefore, it is possible to provide the same effect as that of the first embodiment.

In the present embodiment, shapes of the first plate 6 and the second plate 7 are the same. Therefore, it is possible to use similar first plates 6 and second plates 7.

Third Embodiment

Figure 11:
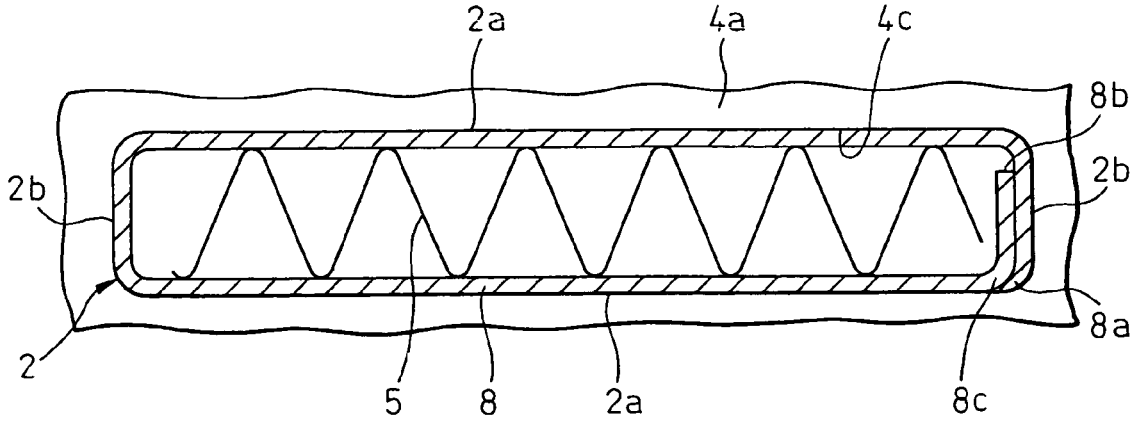
FIG. 11 is a lateral sectional view of the tube of the third embodiment of the present invention.
Figure 12:
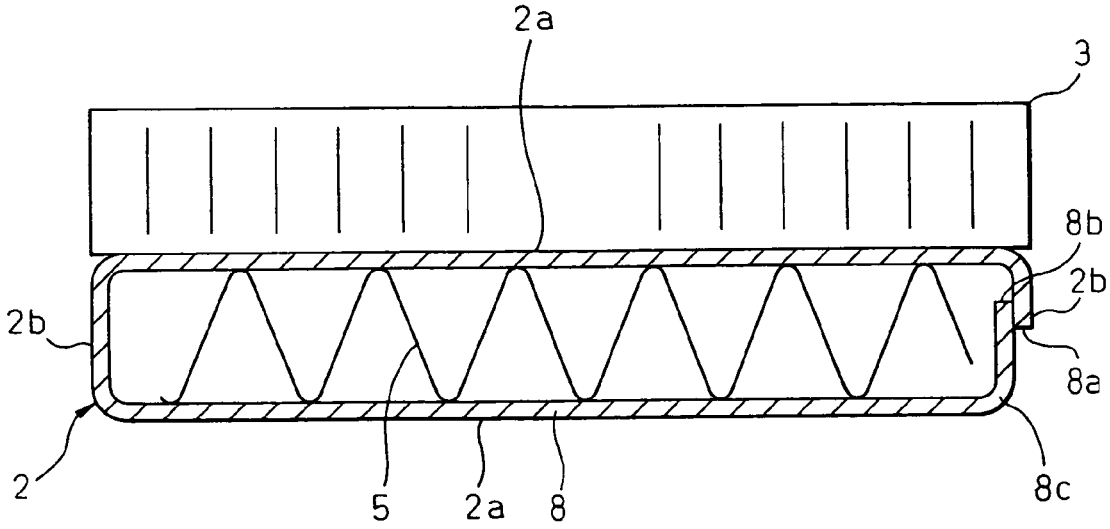
FIG. 12 is a lateral sectional view of the tube of the third embodiment of the present invention.

FIGS. 11 and 12 are lateral sectional views of the tube of the third embodiment of the present invention. In this connection, FIG. 11 is a sectional view taken on line II-II in FIG. 1. FIG. 12 is a sectional view taken on line III-III in FIG. 1. Like reference characters are used to indicate like parts in FIGS. 2, 3 11 and 12.

In the present embodiment, as shown in FIGS. 11 and 12, one flat tube 2 is composed of one plate 8. Concerning this plate 8, on the side 2*b* of the tube 2, while the first edge portion 8*a* of the plate 8 is being located outside the second edge portion 8*b*, the first edge portion 8*a* side of the plate 8 and the second edge portion 8*b* side are put on mutually. This portion in which the first edge portion 8*a* side of the plate 8 and the second edge portion 8*b* side are put on mutually is joined by means of brazing.

This plate 8 is formed into a shape described as follows. As shown in FIG. 11, in the region C of the tube 2, the first edge portion 8*a* is located in a corner portion of the substantial rectangle of the lateral cross-section of the tube 2, that is, the first edge portion 8*a* is located in the bent portion 8*c* on the second edge portion 8*b* side of the plate 8 so that an outer wall face of the tube 2 will be composed of continuous face. In the region D of the tube 2, as shown in FIG. 12, the first edge portion 8*a* is located between the second edge portion 8*b* and the bent portion 8*c* on the second edge portion 8*b* side.

Due to the above structure, the present embodiment can provide the same effect as that of the first embodiment.

Another Embodiment

In each embodiment described above, the tube is formed into a shape, the lateral cross-section of which is a substantial flat rectangle. However, it is possible to apply the present invention to a case in which the tube is formed into another shape. For example, the present invention can be applied to a tube, which is not flat, the lateral cross-section of which is square, or the lateral cross-section of which is cylindrical.

Even in this case, although not shown in the drawing, the outer fin is provided not on all over the outer wall face of the tube but on a partial outer wall face of the tube in the outer circumferential direction of the tube. For example, in the case where the tube is cylindrical, the outer fin is not provided in a portion in the circumferential direction.

The tube is composed in such a manner that the first edge portion of the plate, which composes the tube, is arranged outside the second edge portion and that the first edge portion side and the second edge portion side of the tube are put on mutually and that the portion, in which the first edge portion side and the second edge portion side of the tube are put on mutually, is brazed mutually. The plate is formed into a shape described as follows. In an engagement portion in which the tube and the header plate are engaged mutually and in a portion except for the engagement portion, the first edge portion is formed into a different shape. In the engagement portion, the first edge portion is located at a position where an outer wall face of the tube is composed of continuous face. In the portion except for the engagement portion, the first edge portion is located in a portion on the outer wall face in which the outer fin is not provided.

While the invention has been described by reference to specific embodiments chosen for purposes of illustration, it should be apparent that numerous modifications could be made thereto by those skilled in the art without departing from the basic concept and scope of the invention.

The invention claimed is:

1. A heat exchanger comprising:

a tube defining a first and second engagement portion and a fin portion;

an inner fin disposed within the tube;

a first header plate disposed on a first side of the tube in a longitudinal direction of the tube, the first engagement portion of the tube being disposed within an opening defined by the first header plate;

a second header plate disposed on a second side of the tube in the longitudinal direction of the tube, the second engagement portion of the tube being disposed within an opening defined by the second header plate; and an outer fin disposed only on an outer surface of the fin portion of the tube; wherein the tube is formed by a formed plate, an edge portion of the formed plate extending in the longitudinal direction of the tube is brazed to an outer surface of the formed plate;

a circumferential position on the tube of an edge portion of the first and second engagement portions of the tube is different than a circumferential position on the tube of an edge portion of the fin portion of the tube;

the edge portion of the first and second engagement portions defines a continuous face around an outer surface of the tube; and the edge portion of the fin portion is spaced from the outer fin.

2. The heat exchanger according to claim 1, wherein a lateral cross-section of the tube is formed into a substantial rectangle, the outer fin is provided only on the outer surface of the tube which is a long side of the rectangle, the formed plate includes a first plate having a lateral cross-section formed into a substantial C-shape, and a second plate having a lateral cross-section formed into a substantial C-shape, a portion of the first plate, which becomes a short side of the rectangle engages a portion of the second plate, which becomes a short side of the rectangle, and the first and the second plate are formed in such a manner that in the first and second engagement portions, the edge portion of the formed plate is located at a bent portion of the second plate so that the outer surface of the tube will define the continuous face, and in the fin portion, the edge portion of the formed plate is located between an edge portion of the second plate and the bent portion.

3. The heat exchanger according to claim 2, wherein a circumferential position of the edge portion of the formed plate changes in a displacement portion of the tube, the displacement portion being disposed between the first and second engagement portions and the fin portion.

4. The heat exchanger according to claim 1, wherein a lateral cross-section of the tube is formed into a substantial rectangle, the outer fin is provided only on the outer surface of the tube which is a long side of the substantial rectangle, a first end side and a second end side of the formed plate are in a portion which becomes a short side of the rectangle of the tube, and in the first and second engagement portions, the first end side is located in a bent portion of the formed tube so that the outer wall face of the tube will define the continuous face, and in the fin portion the first end side is located between the second end side of the formed tube and the bent portion.

5. The heat exchanger according to claim 4, wherein a circumferential position of the edge portion of the formed plate changes in a displacement portion of the tube, the displacement portion being disposed between the first and second engagement portions and the fin portion.

6. The heat exchanger according to claim 1, wherein a circumferential position of the edge portion of the formed plate changes in a displacement portion of the tube, the displacement portion being disposed between the first and second engagement portions and the fin portion.

* * * * *